US010964458B2

(12) United States Patent
Kiuchi

(10) Patent No.: US 10,964,458 B2
(45) Date of Patent: Mar. 30, 2021

(54) RESISTOR UNIT

(71) Applicant: DENSO CORPORATION, Kariya (JP)

(72) Inventor: Yuya Kiuchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/825,917

(22) Filed: Mar. 20, 2020

(65) Prior Publication Data

US 2020/0219639 A1 Jul. 9, 2020

Related U.S. Application Data

(63) Continuation of application No. PCT/JP2018/034217, filed on Sep. 14, 2018.

(30) Foreign Application Priority Data

Sep. 20, 2017 (JP) ..... JP2017-179915

(51) Int. Cl.
*H01C 1/028* (2006.01)
*H01C 1/14* (2006.01)

(52) U.S. Cl.
CPC ..... *H01C 1/028* (2013.01); *H01C 1/14* (2013.01)

(58) Field of Classification Search
CPC ..... H01C 1/1028; H01C 1/14
See application file for complete search history.

(56) References Cited

U.S. PATENT DOCUMENTS 2,538,977 A * 1/1951 Mucher ..... H05B 3/48 338/256
3,581,266 A * 5/1971 Weyenberg ..... H01C 1/028 338/253
3,668,598 A * 6/1972 Drugmand ..... H05B 3/46 338/274
3,728,660 A * 4/1973 Finney ..... H01C 7/04 338/22 R
5,888,102 A * 3/1999 Strickland ..... H05K 3/301 361/809
7,420,454 B2 * 9/2008 Takagi ..... H01C 1/08 29/611
9,530,545 B2 * 12/2016 Xu ..... H01H 85/055
2018/0047539 A1 * 2/2018 Kang ..... H01H 85/048
2018/0160538 A1 * 6/2018 Naito ..... H01C 7/003

FOREIGN PATENT DOCUMENTS

JP H03-001402 U 1/1991
JP H03-128902 U 12/1991
JP 2016-019384 A 2/2016
JP 2016-042522 A 3/2016

OTHER PUBLICATIONS

Nov. 27, 2018 International Search Report issued in International Patent Application No. PCT/JP2018/034217.

* cited by examiner

*Primary Examiner* — Kyung S Lee
(74) *Attorney, Agent, or Firm* — Oliff PLC

(57) ABSTRACT

A resistor unit has a case with an opening face, a resistor housed in the case, cement that is filled inside the case to bury the resistor, and a lead-out terminal that is connected to the resistor in the cement and is led out of the cement through the opening face of the case. A lead-out terminal has a protrusion portion that protrudes in an opening direction that is across the opening face, and an extension portion that extends parallel to the opening face from the protrusion portion.

7 Claims, 9 Drawing Sheets

RESISTOR UNIT

CROSS-REFERENCE TO RELATED APPLICATION

The present application is a continuation application of International Application No. PCT/JP2018/034217, filed on Sep. 14, 2018, which claims priority to Japanese Patent Application No. 2017-179915, filed on Sep. 20, 2017. The contents of these applications are incorporated herein by reference in their entirety.

BACKGROUND

Technical Field

The present disclosure relates to a resistor unit.

Background Art

For example, resistor units are provided in power converters, etc., for discharging capacitors. In the prior art, a resistor unit that is formed by filling cement in a case to cover a resistor which is contained in the case is disclosed. Terminals that are connected to the resistor are led out from the case. The terminals protrude through the opening of the case.

SUMMARY

In the present disclosure, provided is a resistor unit as the following. In the resistor unit, a lead-out terminal comprises a protrusion portion that protrudes in an opening direction that is across an opening face, and an extension portion that extends parallel to the opening face from the protrusion portion; a case has a shape that is elongated parallel to the opening face; and, a connection wiring member is led out from a lead-out terminal in a longitudinal direction of the case.

BRIEF DESCRIPTION OF THE DRAWINGS

The above objects and other objects, features and advantages of the present disclosure will be made clearer by the following detailed description, given referring to the appended drawings. In the drawings.

DETAILED DESCRIPTION OF THE PREFERRED EMBODIMENTS

Figure 1:
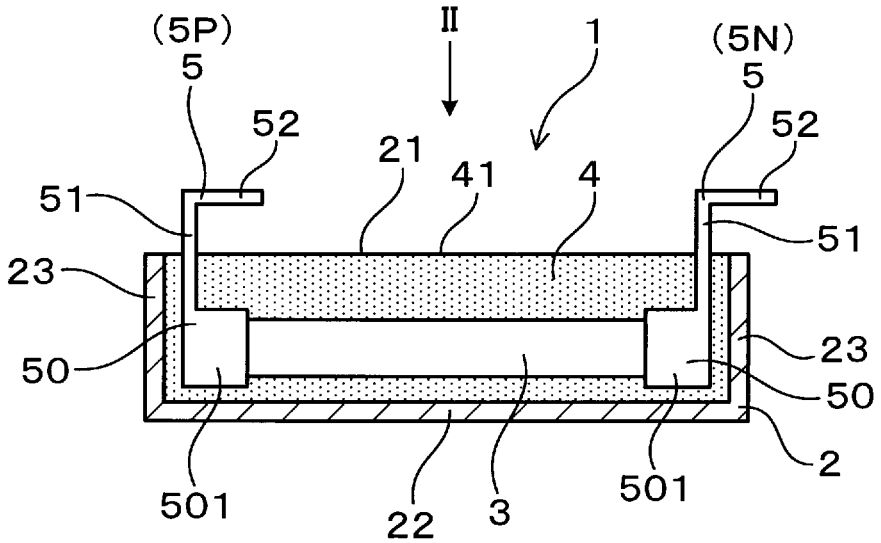
FIG. 1 is a cross-sectional view of a resistor unit in a first embodiment.

With the resistor unit disclosed in Patent Document 1, since the terminals protrude along the opening direction of the case, it is difficult to reduce the size of the resistor unit in the opening direction. Furthermore, when connection wiring members are connected to the terminals, the connection wiring members also extend along the protrusion direction of the terminals. Hence the space required for disposing the resistor unit, in the opening direction of the case, tends to be large. That is, it is difficult to reduce the space required for installing the resistor unit and the connection wiring members. As a result, it is difficult to improve the mountability of the resistor unit in a device such as a power converter in which the resistor unit is to be installed.

It is an objective of the present disclosure to provide a resistor unit having improved mountability in a device.

One aspect of the present disclosure provides a resistor unit comprising:

a case that comprises an opening face, a resistor that is housed in the case, cement that is filled inside the case to bury the resistor, and a lead-out terminal that is connected to the resistor in the cement and is led out of the cement through the opening face of the case;

a wire-shaped connection wiring member that is connected to the lead-out terminal; wherein the lead-out terminal comprises a protrusion portion that protrudes in an opening direction that is across the opening face, and an extension portion that extends parallel to the opening face from the protrusion portion;

the case has a shape that is elongated parallel to the opening face; and, the connection wiring member is led out from the lead-out terminal in a longitudinal direction of the case.

In the resistor unit, the lead-out terminals each have a protrusion portion and an extension portion. As a result, the extent to which the lead-out terminals protrude from the case in the opening direction can be made small. As a result, the size of the resistor unit in the opening direction can be reduced. In addition, by providing the extension portions, the connection wiring members that become connected to the lead-out terminals can readily also be made to extend in a face-oriented direction. As a result, the mounting space required within the device in which the resistor unit is installed, including the mounting space required for the connection wiring members, can be reduced in the opening direction. As a result, the mountability of the resistor unit in devices can be improved.

As described above, according to the above aspect, a resistor unit can be provided which has improved mountability in a device.

It should be noted that symbols shown in parentheses in the claims are provided to indicate correspondence relationships to embodiments described in the following, and do not limit the technical scope of the disclosure.

First Embodiment

An embodiment relating to a resistor unit will be described referring to FIGS. 1 to 8.

The resistor unit 1 of this embodiment includes a case 2, resistors 3, cement 4, and lead-out terminals 5 as shown in FIGS. 1 to 4.

The case 2 has an opening face 21. The resistors 3 are housed within the case 2. The cement 4 is filled in the case 2 to bury the resistors 3. The lead-out terminals 5 are connected to the respective resistors 3 within the cement 4 and are led out of the cement 4 through the opening face 21 of the case 2.

Each lead-out terminal 5 has a protrusion portion 51 and an extension portion 52. The protrusion portion 51 protrudes in the opening direction that is across the opening face 21. The extension portion 52 extends parallel to the opening face 21 from the protrusion portion 51.

The extension portion 52 may be a part that extends parallel to the opening face 21 from the protrusion portion 51, and therefore the extension portion 52 is not limited to be along the opening face 21. That is, each lead-out terminal 5 may have, as the extension portion 52, a portion that extends in a direction parallel to the opening face 21 even if the portion does not overlap with the opening face 21.

The case 2 has a substantially rectangular parallelepiped shape, with one surface thereof constituting the opening face 21. That is, the case 2 has a bottom surface portion 22, and four side surface portions 23 that stand in the normal direction of the bottom face portion 22, surrounding the entire circumference of the bottom surface portion 22. The bottom surface portion 22 has a larger area than that of each of the side surface portions 23. The case 2 is made of ceramic, for example.

Figure 3:
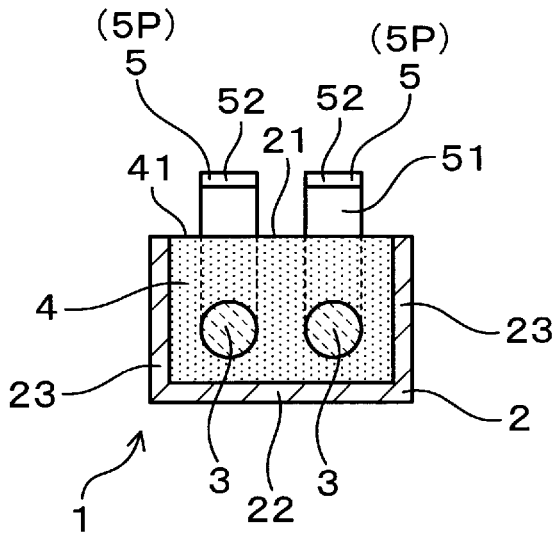
FIG. 3 is a cross-sectional view taken along line of FIG. 2.
Figure 4:
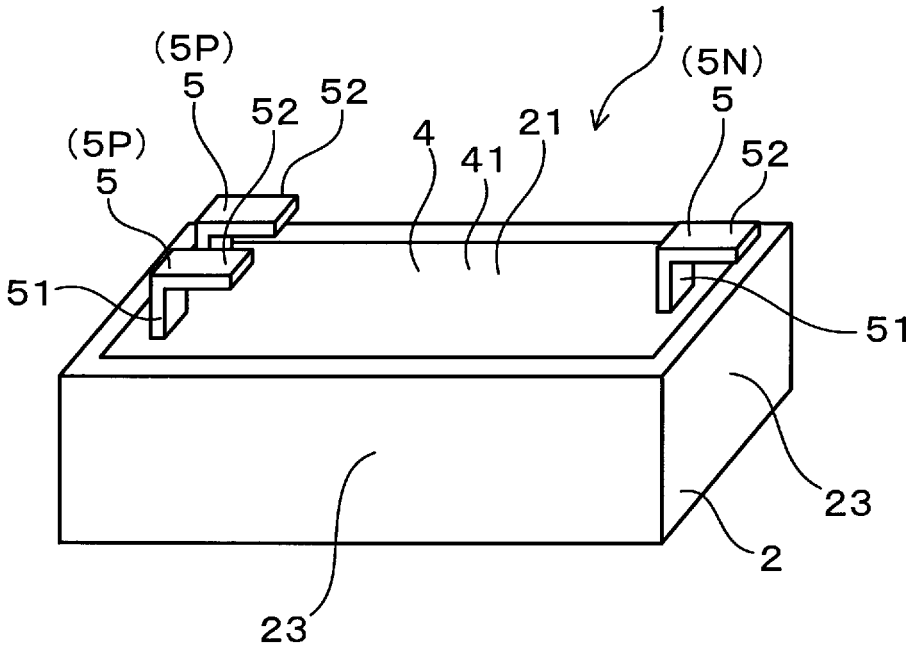
FIG. 4 is a perspective view of a resistor unit of the first embodiment.

As shown in FIGS. 1 and 3, the resistors 3 are disposed along the bottom surface portion 22 within the case 2. The number of resistors 3 according to the present embodiment is set to two. Each resistor 3 has a substantially cylindrical shape. Each resistor 3 is elongated along the axial direction of the cylindrical shape thereof. The two resistors 3 are arranged substantially parallel to each other.

Furthermore the two resistors 3 have substantially the same position in the opening direction. Moreover, each resistor 3 has opposing first and second end portions. The first ends of the respective resistors 3 are aligned in an array direction in which the two resistors 3 are arrayed, and the second ends of the respective resistors 3 are also aligned in the array direction. Terminal members 50, each of which is made of metal, are attached to the respective first and second end portions of each resistor 3.

Figure 2:
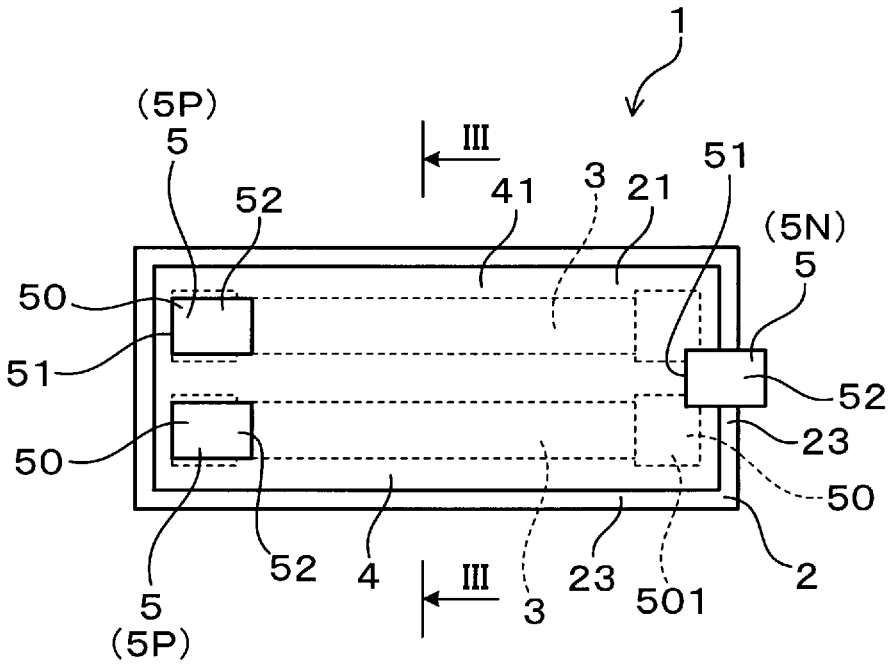
FIG. 2 is a view in the direction of the arrow II of FIG. 1.

As shown in FIGS. 1 and 2, each terminal member 50 for the corresponding one of the first end portions includes a retaining portion 501 and the corresponding one of the lead-out terminals 5. The retaining portion 501 of each terminal member 50 for the corresponding one of the first end portions is joined to the corresponding one of the first end portions to retain the corresponding one of the first end portions. The lead-out terminal 5 of each terminal member 50 for the corresponding one of the first end portions is configured to extend from the retaining portion of the 501 corresponding terminal member 50.

The terminal members 5 joined to the respective first end portions of the two resistors 3 are independent from each other. That is, the terminal members 5 joined to the respective first end portions of the two resistors 3 are separate members from each other, and are electrically isolated from each other.

The lead-out terminals 5 to which the individual terminal members 50 are joined serve as positive lead-out terminals.

The terminal member 50 for the corresponding one of the second end portions includes a retaining portion 501. The retaining portions 501 joined to the respective second end portions of the two resistors 3 are electrically connected to each other.

The terminal members 50, which are joined to each other via their retaining portions 501, include the corresponding lead-out terminal 5 shared with each other. That is, the retaining portions 501 joined to the respective second end portions of the two resistors 3 are joined to the corresponding lead-out terminal 5. The lead-out terminal 5 to which the retaining portions 501 of the respective resistor 3 are joined serves a negative lead-out terminal.

As shown in FIGS. 1 to 4, the cement 4 is filled in the case 2 such as to bury the resistors 3. The cement 4 has an exposed surface 41 which is exposed at the opening face 21 of the case 2. The exposed surface 41 is formed at a position corresponding to that of the end face of the side surface portions 23 of the case 2, with respect to the opening direction. The exposed surface 41 is a plane that is substantially parallel to the opening face 21.

The lead-out terminals 5 protrude from the exposed surface 41 in the opening direction. The protrusion portion 51 of each lead-out terminal 5 is substantially orthogonal to the exposed surface 41. Furthermore the extension portion 52 of each lead-out terminal 5 is disposed substantially parallel to the exposed surface 41.

The extension portion 52 has a flat plate shape. The normal direction of a major face of the extension portion 52 faces the opening direction across the opening face 21. That is to say, the extension portion 52 is disposed substantially parallel to the opening face 21. In other words, the extension portion 52 is disposed substantially parallel to the exposed surface 41, facing the exposed surface 41. Moreover in this embodiment the protrusion portion 51 also has a flat shape. Furthermore the major faces of the protrusion portion 51 faces the direction of elongation of the resistors 3. In addition, the case 2 has a shape that is elongated along the direction of elongation of the resistors 3. In the following, a direction that is along the direction of elongation of the resistors 3 is referred to simply as the □longitudinal direction□.

The protrusion portions 51 and the extension portions 52 are formed in a state in which a metal plate is bent substantially at right angles.

Each resistor 3 has a shape that is elongated in a direction parallel to the opening face 21. the extension portion 52 is arranged to extend from the protrusion portion 51 in the longitudinal direction of the resistors 3.

At least one of the lead-out terminals 5 is arranged such that the extension portion 52 overlaps a resistor 3, as viewed in the opening direction.

In this embodiment, as shown in FIGS. 1 to 3, the extension portion 52 of each positive lead-out terminal 5P is arranged such as to overlap a resistor 3 in the opening direction. On the other hand, the extension portion 52 of the negative lead-out terminal 5N does not overlap a resistor 3, as viewed in the opening direction. However the extension portion 52 of the lead-out terminal 5N partially overlaps the exposed surface 41 of the cement 4 as viewed in the opening direction.

As shown in FIGS. 1 to 4, the plurality of lead-out terminals 5 are configured that the extension portions 52 extend from the respective protrusion portions 51 in the direction parallel to the opening face 21. With the present embodiment the resistor unit 1 has three lead-out terminals 5. The three lead-out terminals 5 are configured that the extension portions 52 extend from the respective protrusion portions 51 in a direction parallel to the opening face 21. That is, the three extension portions 52 each extend to the same side in a longitudinal direction.

Furthermore the height to which each protrusion portion 51 protrudes from the opening face 21 of the case 2 is substantially the same for all three of the protrusion portions 51.

Figure 5:
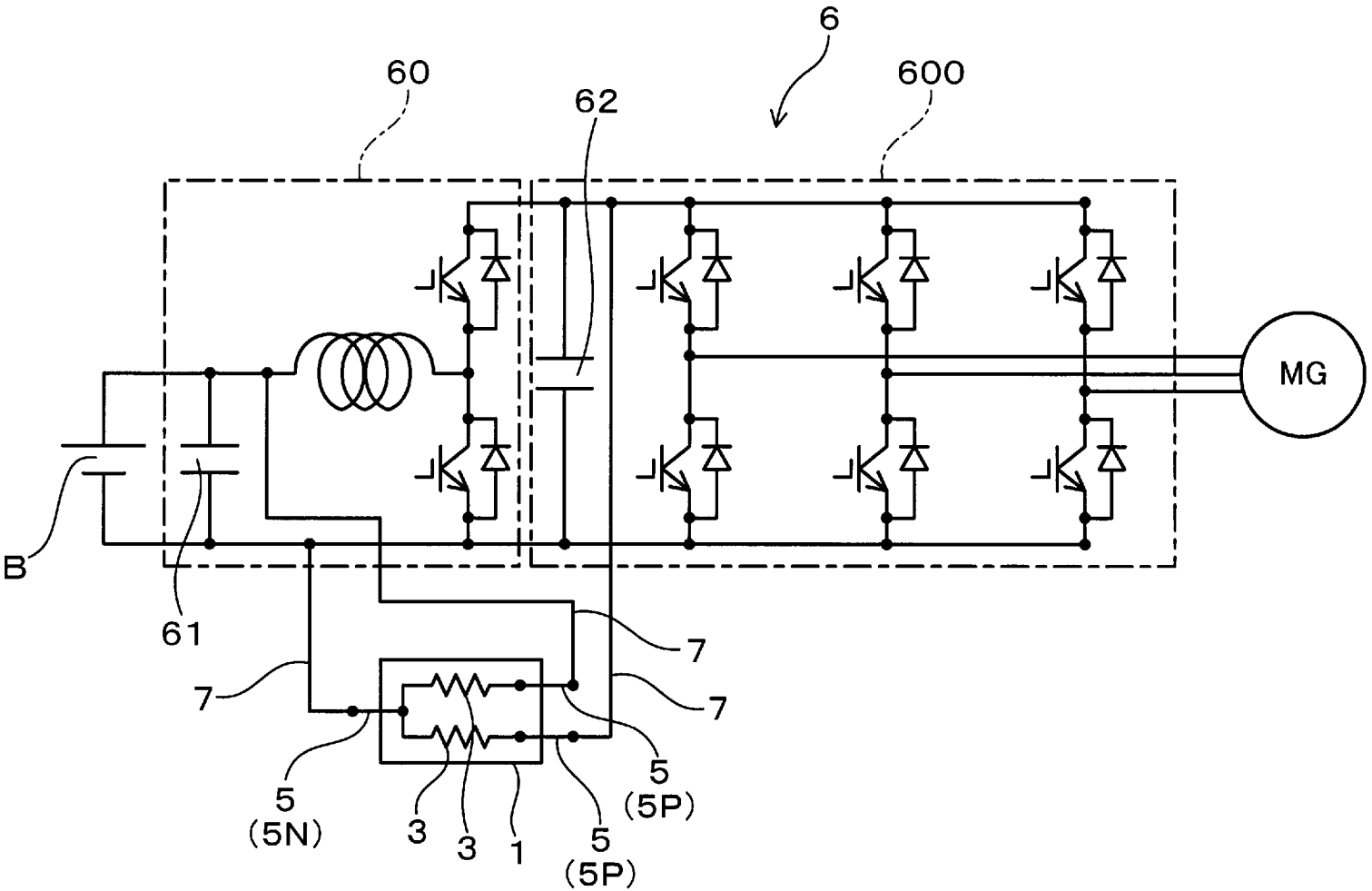
FIG. 5 is a circuit diagram of a power converter that is equipped with the resistor unit of the first embodiment.

In this embodiment, the resistor unit 1 is mounted on the power converter 6 whose circuit diagram is shown in FIG. 5. The resistor unit 1 constitutes a discharge resistor, for discharging the electric charges in the capacitors 61 and 62. As shown in FIG. 5, the power converter 6 includes a voltage booster 60 and an inverter 600. The power converter 6 is provided between a DC power supply B and an AC load MG, and performs power conversion between DC power and AC power. The voltage booster 60 has a filter capacitor 61. The inverter 600 includes a smoothing capacitor 62.

The resistor unit 1 is configured to be able to efficiently discharge both the charge in the filter capacitor 61 and the charge in the smoothing capacitor 62. That is, one of the two resistors 3 in the resistor unit 1 is connected to a position that is electrically close to the filter capacitor 61, and is connected in parallel with the filter capacitor 61. The other resistor 3 in the resistor unit 1 is connected to a position that is electrically close to the smoothing capacitor 62, and is connected in parallel with the smoothing capacitor 62. The charge in the filter capacitor 61 and the charge in the smoothing capacitor 62 can thereby be discharged through the corresponding resistor 3. Hence the charge in the filter capacitor 61 and the charge in the smoothing capacitor 62 can be discharged concurrently, so that discharging can be performed efficiently.

Figure 6:
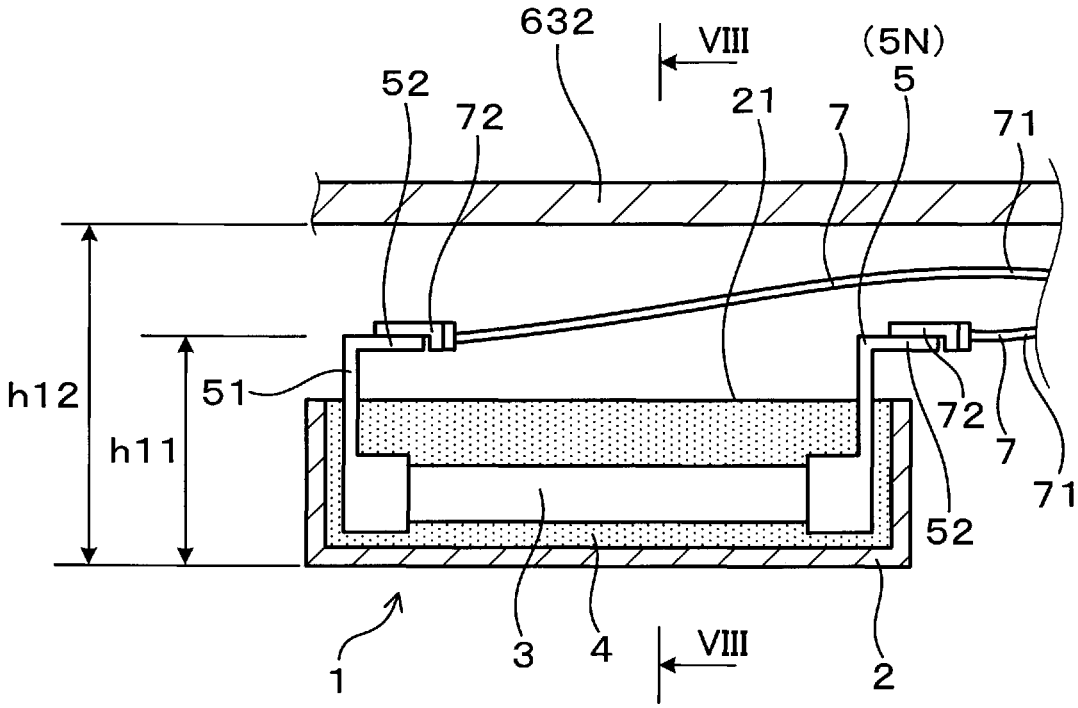
FIG. 6 is a cross-sectional view showing a condition in which the resistor unit of the first embodiment is mounted in a power converter.
Figure 7:
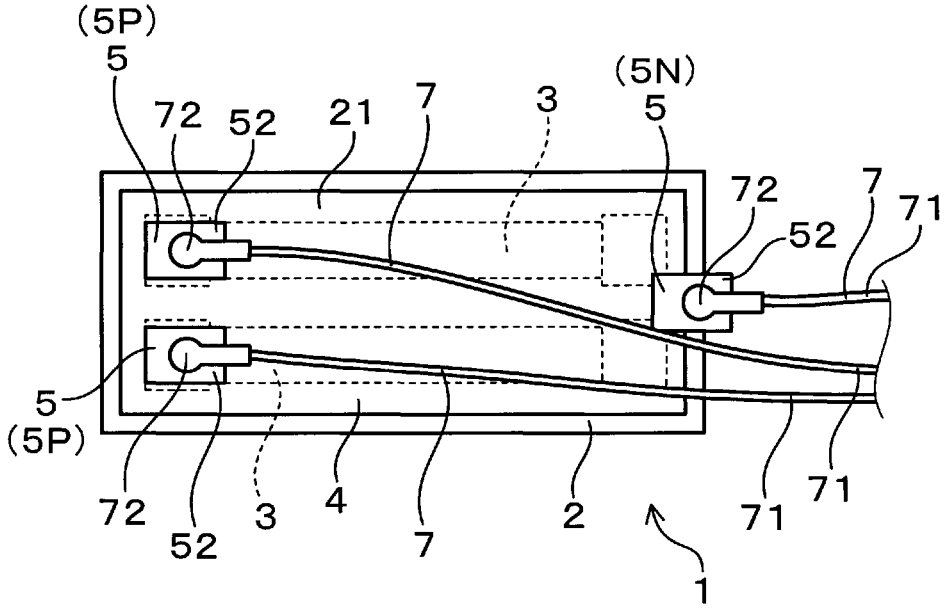
FIG. 7 is a plan view of the resistor unit of the first embodiment with connection wiring members connected thereto.

As shown in FIGS. 6 and 7, the resistor unit 1 is disposed in the power converter 6 in a condition whereby each connection wiring member 7 is connected to each lead-out terminal 5. Each connection wiring member 7 has a covered conductive wire 71 and a terminal fitting 72 provided at the end thereof. The terminal fitting 72 of each connection wiring member 7 is connected to the tip of the extension portion 52 of the corresponding lead-out terminal 5. The extension portion 52 and the terminal fitting 72 can be joined by welding, soldering or the like, for example.

As shown in FIG. 5, there are three connection wiring members 7 and two resistors 3 in the circuit diagram. A first connection wiring member 7 connects the positive lead-out terminal 5P of a first resistor 3 to a wire that is in the voltage booster 60 and is at the same potential as that of the positive electrode of the DC power supply B. A second connection wiring member 7 connects the positive lead-out terminal 5P of a second resistor 3 to the positive electrode wire of the inverter 600. A third connection wiring member 7 connects the negative lead-out terminal 5N of the two resistors 3 to the negative electrode wire of the voltage booster 60 and the inverter 600.

Figure 8:
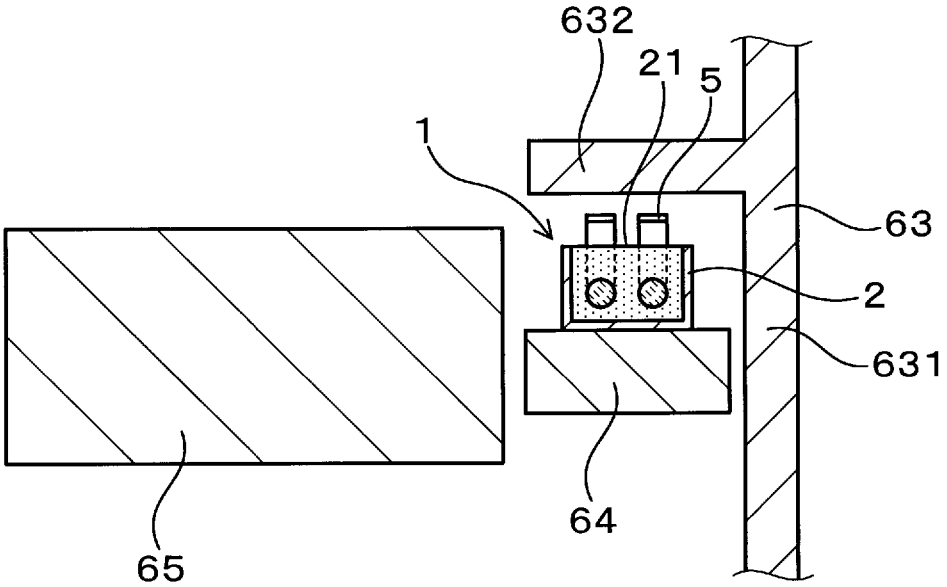
FIG. 8 is a cross-sectional view showing a condition in which the resistor unit of the first embodiment is mounted in a power converter, corresponding to a cross-section taken along line VIII-VIII in FIG. 6.

The resistor unit 1, with the connection wiring members 7 connected in that manner, is disposed in the housing 63 of the power converter 6 as shown in FIG. 8. The resistor unit 1 is fixed to the housing 63 while mounted on a holder 64. For example as shown in FIG. 8, the resistor unit 1 mounted on the holder 64 is disposed between a switching circuit portion 65 having a semiconductor module, and wall portions 631 and 632 of the housing 63. That is, the resistor unit 1 is disposed within a space that is surrounded by the switching circuit portion 65 and the wall portions 631 and 632 of the housing 63.

As shown in FIGS. 6 and 8, the resistor unit 1 is disposed in a condition whereby the opening face 21 of the case 2 faces the wall portion 632. The housing 63 consists of metal members such as aluminum, for example. It should be noted that that this arrangement of the resistor unit 1 serves only as an example, and that there are no particular limitations on the manner of mounting. The resistor unit 1 may be mounted in the housing 63 after connecting each connection wiring member 7 to the corresponding lead-out terminal 5, or the resistor unit 1 may be first mounted in the housing 63 and each connection wiring member 7 then connected to the corresponding lead-out terminal 5.

The functions and effects of this embodiment will next be described.

In the resistor unit 1, each lead-out terminal 5 has a protrusion portion 51 and an extension portion 52. As a result, the extent of protrusion of the lead-out terminal 5 from the case 2 along the opening direction can be reduced. It is thereby made possible to reduce the size of the resistor unit 1 in the opening direction. In addition, by providing the extension portions 52, the extension directions of the connection wiring members 7 connected to the lead-out terminals 5 respectively are also likely to be parallel to the opening face 21. Hence the mounting space for the resistor unit 1 in the power converter 6 including the mounting space required for the connection wiring members 7, can be reduced in the opening direction. The mountability of the resistor unit 1 in the power converter 6 can thereby be improved.

Thus for example, as shown in FIG. 8, the wall portion 632 of the housing 63 can be brought close to the opening face 21 of the resistor unit 1. As a result, the heat dissipation of the resistor unit 1 can be improved.

Furthermore each extension portion 52 has a flat plate shape, and the normal direction of a major face of the extension portions 52 is along the opening direction. This makes it easier to reduce the size of the resistor unit 1 with respect to the opening direction. In addition, part of the noise radiated from the resistors 3 to the opening side can be shielded by the extension portions 52. Hence it is possible to suppress the effects of the noise on electronic components, etc., that are close to the resistors 3.

Furthermore at least one of the lead-out terminals 5 is arranged such that the extension portion 52 thereof overlaps the corresponding resistor 3, as viewed from the opening side in the opening direction. It is thereby made easy to also reduce the size of the resistor unit 1 in the direction which is parallel to the opening face 21. In addition, part of the noise radiated from the resistors 3 to the opening side can be shielded by the corresponding extension portions 52. Hence it is possible to suppress the effects of the noise on electronic components, etc., that are close to the resistors 3.

Furthermore each extension portion 52 is arranged to extend from the corresponding protrusion portion 51 along the longitudinal direction of the corresponding resistor 3. The resistor unit 1 can thereby be reduced in size not only in the opening direction but also in the width direction, orthogonal to both the longitudinal direction and the opening direction. As shown in FIGS. 6 and 7, each connection wiring member 7 can easily be arranged along the longitudinal direction when connected to the corresponding lead-out terminal 5. As a result, the mountability of the resistor unit 1 in the power converter 6, including the mountability of the connection wiring members in the power converter 6, can be further improved.

The plurality of lead-out terminals 5 are arranged such that the direction in which each of the extension portions 52 extends from the corresponding protrusion portion 51 is the same direction which is parallel to the opening face 21. Hence the plurality of connection wiring members 7 that are connected to the plurality of lead-out terminals 5 respectively can be led out to the same side, in the direction which is parallel to the opening face 21. Thus the arranging of the plurality of connection wiring members 7 can readily be simplified. For example, the plurality of connection wiring members 7 can be partially bundled. As a result, the mountability of the resistor unit 1, including the mountability of the plurality of connection wiring members 7, can be further improved.

As described above, according to the present embodiment, a resistor unit can be provided that has improved mountability in devices.

Comparative Example

Figure 9:
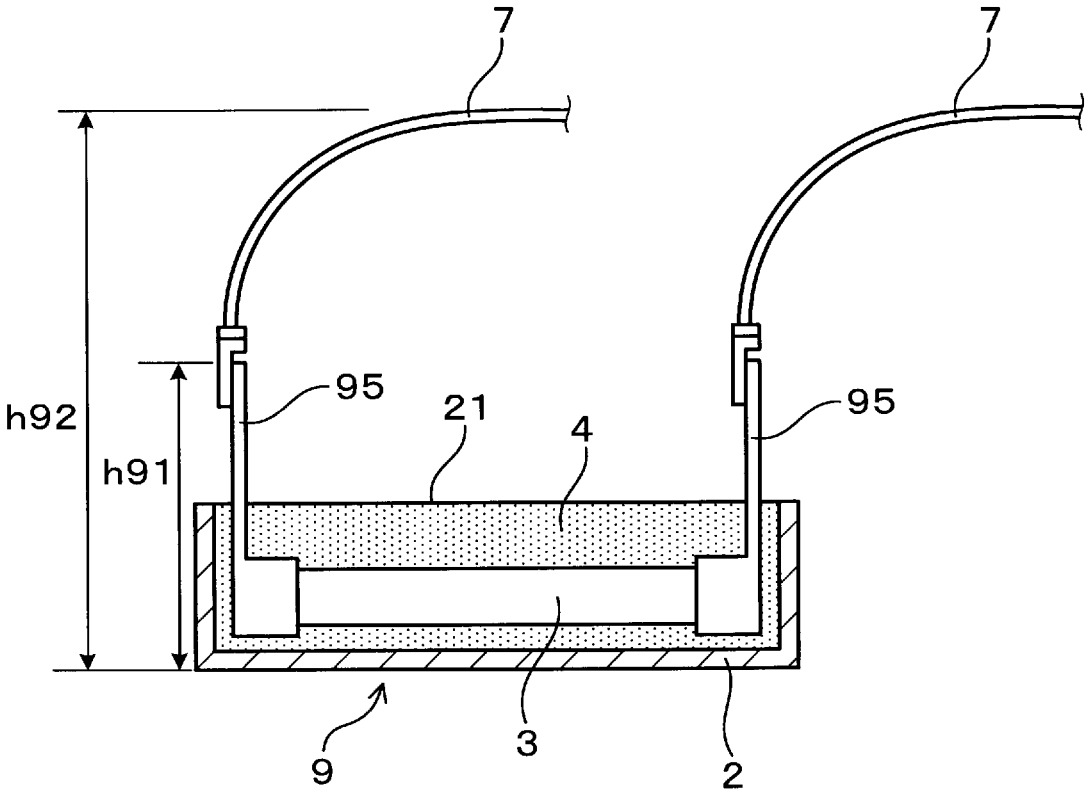
FIG. 9 is a cross-sectional view of a resistor unit in a comparative embodiment.

As shown in FIG. 9, this comparison example has the form of a resistor unit 9 in which each lead-out terminal 95 protrudes in the opening direction across the opening face 21.

In other respects, this is identical to the resistor unit 1 of the first embodiment. It should be noted that with this comparative example and subsequent embodiments, reference numerals used which are identical to reference numerals used for preceding embodiments indicate the same constituent elements, etc., as in the preceding embodiments, unless otherwise specified.

In this comparative embodiment, since the lead-out terminals 95 stand along the opening direction, the size of the resistor unit 9 in the opening direction is likely to increase. Hence the dimension h91 shown in FIG. 9 is larger than the dimension h11 of the resistor unit 1 in the opening direction in the first embodiment shown in FIG. 1.

Furthermore each connection wiring member 7 connected to the corresponding lead-out terminal 95 is led out along the opening direction. Hence the dimension h92 of the mounting space of the resistor unit 9 in the opening direction, including the space required for routing each connection wiring member 7, is also larger than that in the first embodiment (dimension h12 in FIG. 6).

In that way, the resistor unit 9 of this comparison example has room for improvement, from the aspect of mountability in devices. By comparison with this, the resistor unit 1 of the first embodiment can provide greatly improved mountability in devices.

Second Embodiment

Figure 10:
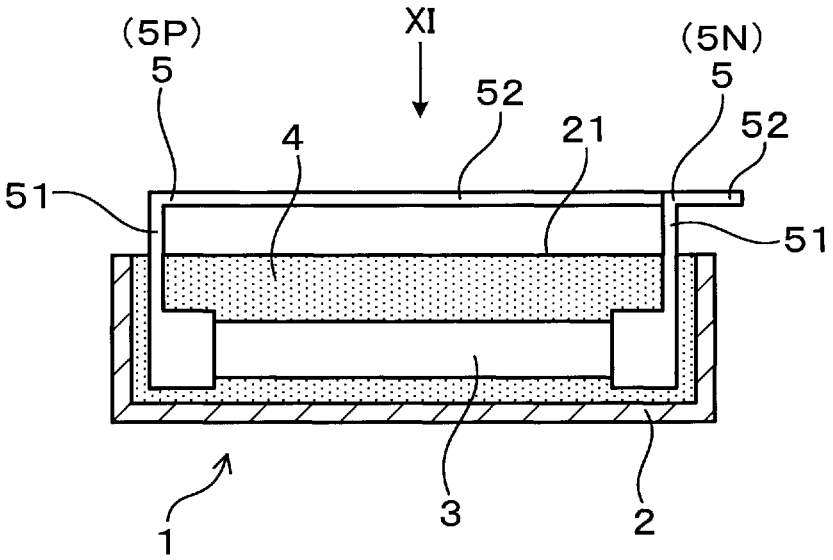
FIG. 10 is a cross-sectional view of a resistor unit of a second embodiment.
Figure 11:
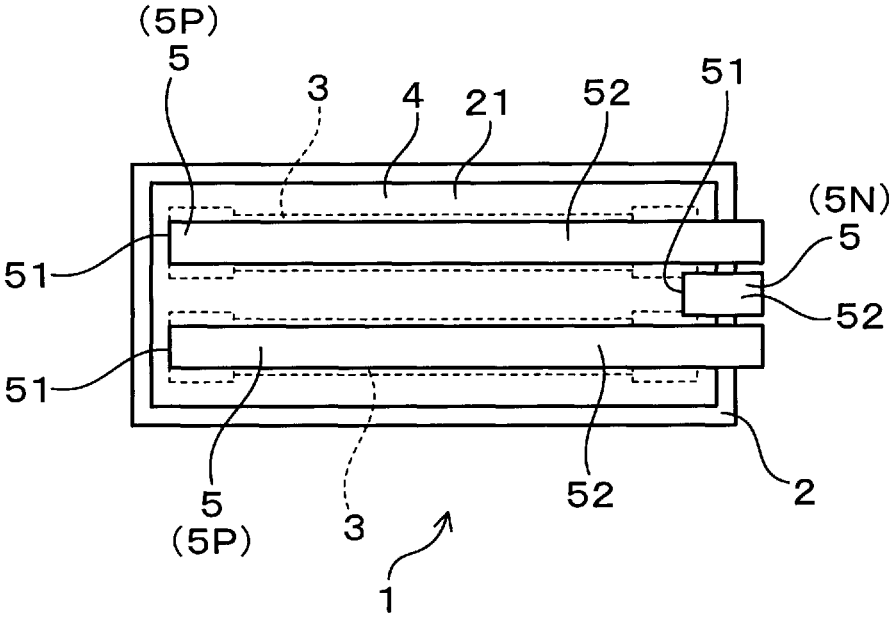
FIG. 11 is a view taken along the direction XI in FIG. 10.

As shown in FIGS. 10 and 11, the present embodiment provides a resistor unit 1 in which respective extension portions 52 of at least one of the lead-out terminals 5 are arranged over most of the opening face 21 in the longitudinal direction.

That is to say, each resistor 3 has a first end and a second end. The extension portion 52 of the lead-out terminal 5 connected to the first end of each resistor 3 is arranged to extend to the vicinity of the second end of each resistor 3. With the present embodiment, the extension portion 52 of a positive lead-out terminal 5P has an elongated shape over most of the opening face 21 in the longitudinal direction. Furthermore the respective extension portions 52 of two lead-out terminals 5P have an elongated shape. These elongated extension portions 52 are disposed such as to overlap the corresponding resistors 3, as viewed from the opening side in the opening direction.

On the other hand, the extension portion 52 of the negative lead-out terminal 5N extends outward from the second end of each resistor 3. As shown in FIG. 11, the respective extension portions 52 of two positive lead-out terminals 5P and the extension portion 52 of the single negative lead-out terminal 5N extend to the same side in the longitudinal direction. These three extension portions 52 are arrayed in the direction that is orthogonal to the longitudinal direction which is parallel to the opening face 21. In particular, in this embodiment, the extension portion 52 of the negative lead-out terminal 5N is disposed between the respective extension portions 52 of the two positive lead-out terminals 5P.

In other respects, the configuration is the same as for the first embodiment.

With the present embodiment, the extension portion 52 of each lead-out terminal 5 is disposed so as to face a resistor 3 in the opening direction in a wide range. Hence, noise from each resistor 3 can be more effectively shielded by the corresponding extension portion 52. Furthermore by forming the extension portion 52 of at least one of the lead-out terminals 5 with an elongated shape, it becomes possible to effectively dissipate heat from each resistor 3 via the corresponding lead-out terminal 5. Moreover the tip of the extension portion 52 of each positive lead-out terminal 5 can be disposed close to the tip of the extension portion 52 of the negative lead-out terminal 5. Connection of each connection wiring member 7 to the corresponding lead-out terminal can thereby be efficiently performed.

Other functions and effects provided are similar to those of the first embodiment.

Third Embodiment

Figure 12:
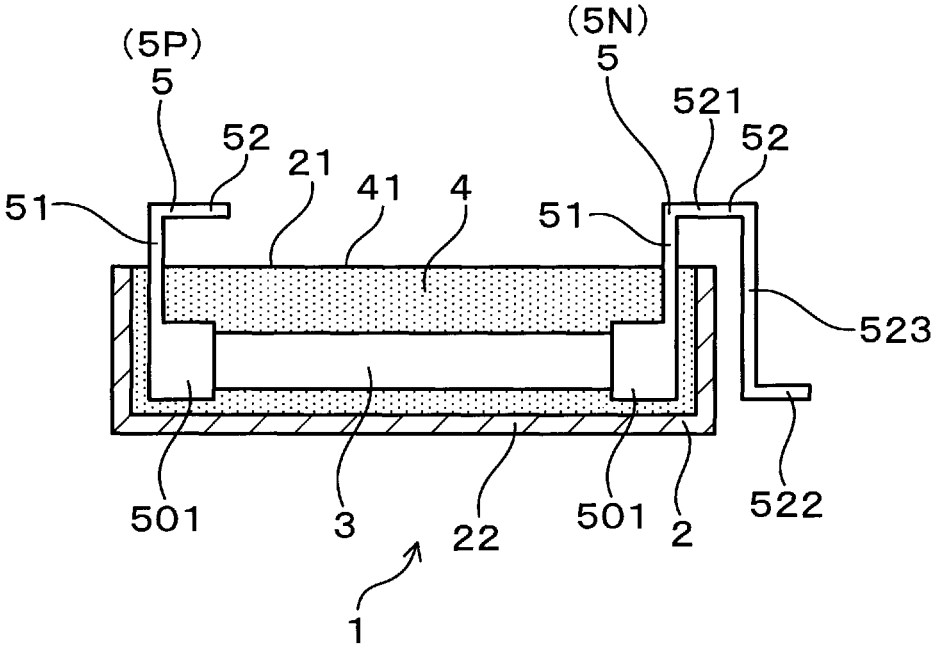
FIG. 12 is a cross-sectional view of a resistor unit of a third embodiment.

With the present embodiment, a resistor unit 1 is arranged such that the extension portion 52 of at least one of the lead-out terminals 5 has a first extension portion 521 and a second extension portion 522, disposed at different positions in the opening direction respectively, as shown in FIG. 12.

The first extension portion 521 extends outward in the longitudinal direction from a protrusion portion 51. The first extension portion 521 has a first end on the protrusion portion 51 side and a second end on the opposite side to the protrusion portion 51. An intermediate portion 523 extends in the opening direction, from the second end of the first extension portion 521 toward the bottom surface portion 22 side. The intermediate portion 523 has a first end on the first extension portion 521 side and a second end on the opposite side to the first extension portion 521. A second extension portion 522 extends outward, in the longitudinal direction of each resistor 3, from the second end of the intermediate portion 523. A connection wiring member 7 is connected to the tip of the second extension portion 522.

With the present embodiment, the lead-out terminal 5 having the first extension portion 521 and the second extension portion 522 is the negative lead-out terminal 5N. The positive lead-out terminals 5P are identical to those of the first embodiment. However it would be equally possible for the positive lead-out terminals 5P to have the same shape as that of the negative lead-out terminal 5N described above.

In other respects, the configuration is the same as for the first embodiment.

With the present embodiment, a connection wiring member 7 can be connected to the second extension portion 522 of the lead-out terminal 5N. Hence the connection part that connects a connection wiring member 7 to the lead-out terminal 5N can be disposed closer to the bottom surface portion 22 than to the opening face 21. It is thereby made easier to achieve a reduction in the height of the resistor unit 1, including the connection wiring members 7, in the opening direction.

Furthermore since the portion of the lead-out terminal 5N that is exposed from the cement 4 becomes longer, dissipation of heat from the resistor unit 1 through the lead-out terminal 5N can be further improved.

Other functions and effects provided are similar to those of the first embodiment.

Fourth Embodiment

Figure 13:
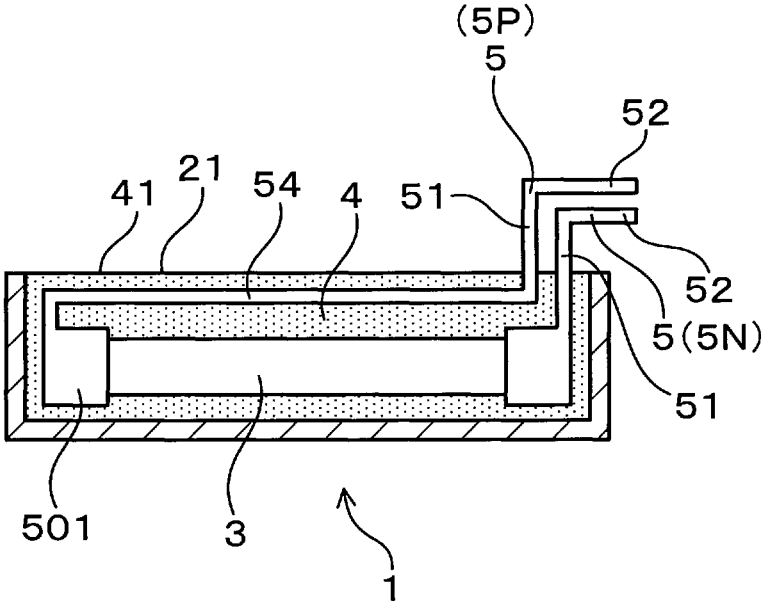
FIG. 13 is a cross-sectional view of a resistor unit of a fourth embodiment.

With the present embodiment, a resistor unit 1 is arranged such that at least one of the lead-out terminals 5 includes an internal connection portion 54 that is arranged between the protrusion portion 51 and the retaining portion 501, along the longitudinal direction as shown in FIG. 13.

The internal connection portion 54 is embedded inside the cement 4. The internal connection portion 54 extends from the retaining portion 501 joined to the first end portion of a resistor 3, toward the second end portion of the resistor 3. Furthermore the internal connection portion 54 is disposed within the cement 4 such as to face the resistor 3 in the opening direction.

The internal connection portion 54 has a first end on the retaining portion 501 side and a second end on the opposite side to the retaining portion 501. The protrusion portion 51 protrudes in the opening direction, extending from the second end of the internal connection portion 54. The protrusion portion 51 protrudes from the opening face 21. The protrusion portion 51 has a first end on the internal connection portion 54 side and a second end on the opposite side to the internal connection portion 54. An extension portion 52 is arranged extending outward in the longitudinal direction from the second end of the protrusion portion 51.

With the present embodiment internal connection portions 54 are provided in the positive lead-out terminals 5P. The negative lead-out terminal 5N is identical to that of the first embodiment. Hence the extension portions 52 of the positive lead-out terminals 5P and the extension portion 52 of the negative lead-out terminal 5N each extend in the longitudinal direction to the same side.

In other respects, the configuration is the same as for the first embodiment.

With the present embodiment, the internal connection portion 54 of the lead-out terminal 5 is disposed such as to face a resistor 3 in the opening direction over a wide range. Hence noise from the resistor 3 can be more effectively shielded by the lead-out terminals 5. In particular, since the internal connection portion 54 and the corresponding resistor 3 face each other within the cement 4, the distance between them can readily be made small. Noise from the resistor 3 can thereby be shielded more effectively.

In addition, since the surface area of corresponding the lead-out terminal 5 in the cement 4 can easily be increased, the corresponding lead-out terminal 5 can readily receive heat from the resistor 3 inside the cement 4. Heat dissipation via the lead-out terminal 5 can thereby be performed more efficiently.

Other functions and effects provided are similar to those of the first embodiment.

Fifth Embodiment

Figure 14:
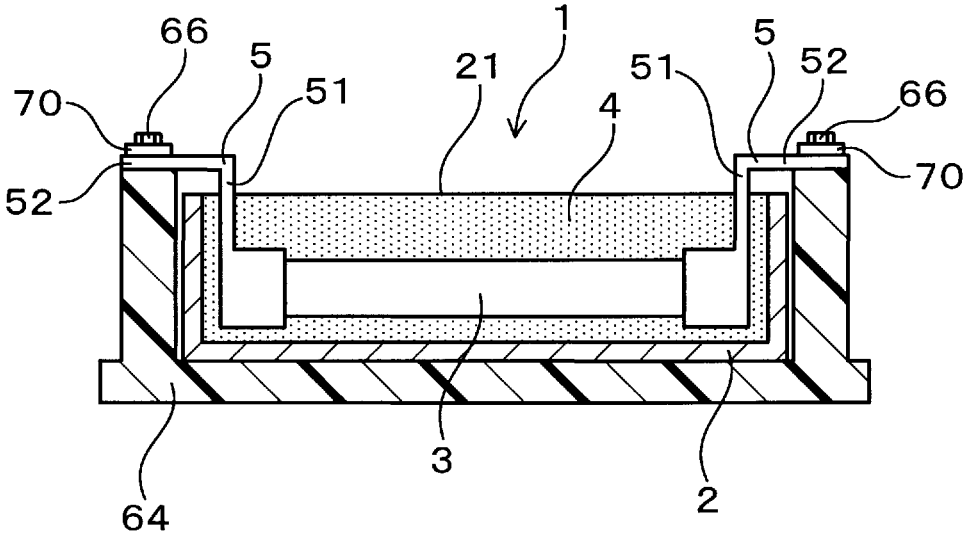
FIG. 14 is a cross-sectional view of a resistor unit of a fifth embodiment.

As shown in FIG. 14, the present embodiment is a resistor unit 1 configured such that each lead-out terminal 5 is attached to the corresponding bus bar 70.

In other words, with this embodiment, as the connection wiring member, a bus bar 70 made of a metal plate is connected to the corresponding lead-out terminal 5 instead of a wire-shaped covered conductive wire (see numeral 71 in FIGS. 6,7).

Each lead-out terminal 5 and the corresponding bus bar 70 are fastened to each other by a bolt 66. Each lead-out terminal 5 are fixed to the holder 64 together with the corresponding bus bar 70. The holder 64 is made of an insulating material such as resin.

In this embodiment, the extension portion 52 of the corresponding lead-out terminal 5 extends outward in the longitudinal direction of the resistors 3. Each extension portion 52 extends outward over the exterior of the case 2. The extension portion 52 of each lead-out terminal 5 is stacked with the corresponding bus bar 70 along the opening direction. Each bus bars 70 has an insertion hole through which the bolt 66 is inserted, and and each extension portion 52 also has an insertion hole through which the bolt 66 is inserted. The bolts 66 are inserted into these insertion holes respectively and screwed into female screws provided in the holder 64 respectively, to thereby attach the lead-out terminals 5 to the holder 64 together with the bus bars 70 respectively.

In other respects, the configuration is the same as for the first embodiment.

With the present embodiment, the lead-out terminals 5 can be directly fixed to the bus bars 70 respectively. Vibration of the lead-out terminals 5 can thereby be suppressed. As a result, the vibration resistance of the connection portions can be improved. Furthermore heat is readily dissipated from the resistor unit 1 to the bus bars 70. A resistor unit 1 having excellent heat dissipation capability can thus be provided.

Other functions and effects provided are similar to those of the first embodiment.

Sixth Embodiment

Figure 15:
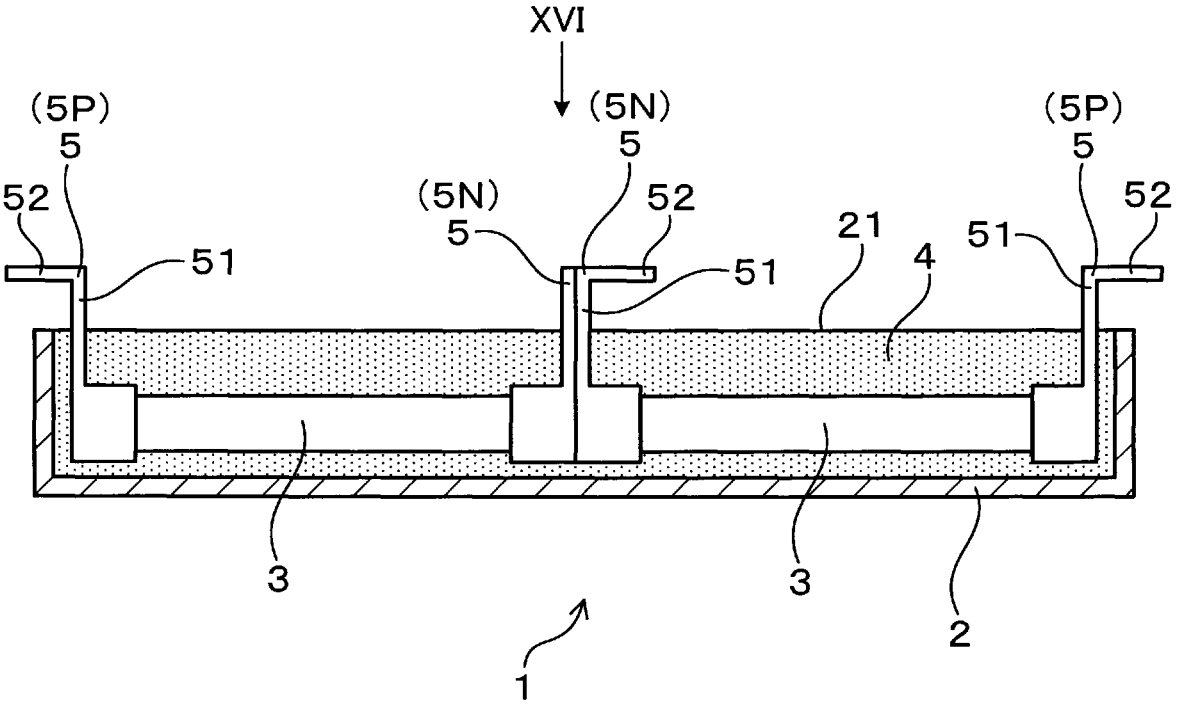
FIG. 15 is a cross-sectional view of a resistor unit in of a sixth embodiment.
Figure 16:
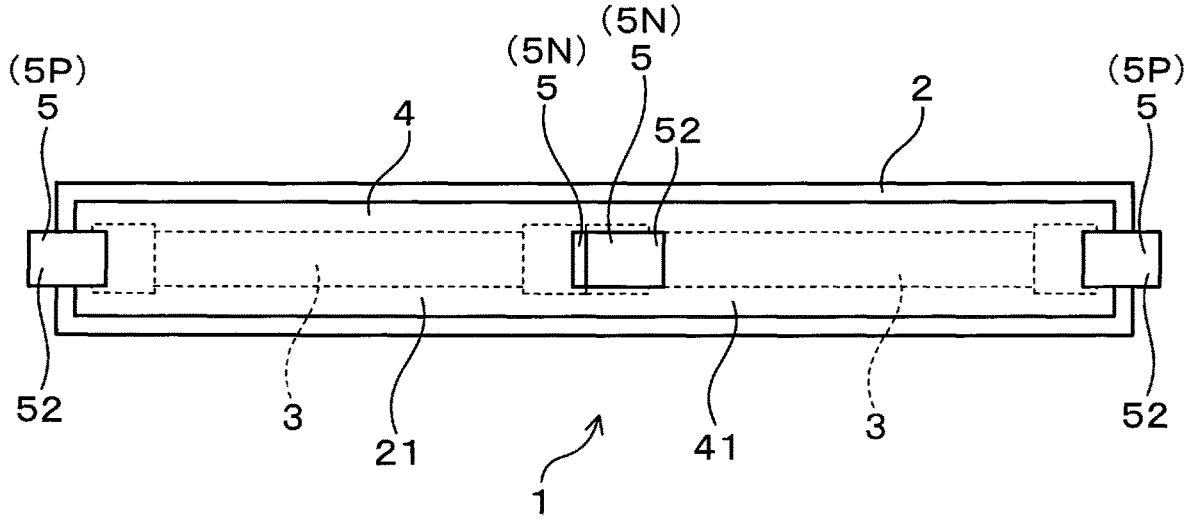
FIG. 16 is a view taken along the direction XVI in FIG. 15.

This embodiment is a resistor unit 1 having a first resistor 3 and a second resistor 3 arranged in the longitudinal direction, as shown in FIGS. 15 and 16.

The negative lead-out terminal 5N of the first resistor 3 and the negative lead-out terminal 5N of the second resistor 3 are connected together. The connected first resistor 3 and second resistor 3, as a whole, has a first end part, a second end part, and a central part in the longitudinal direction, The negative lead-out terminal 5N of the first resistor 3 and the negative lead-out terminal 5N of the second resistor 3 are disposed in the central part. At least one of the negative lead-out terminal 5N of the first resistor 3 and the negative lead-out terminal 5N of the second resistor 3 has an extension portion 52.

The positive lead-out terminal 5P of the first resistor 3 is disposed near the first end part, and the positive lead-out terminal 5P of the second resistor 3 is disposed near the second end part. The extension portion 52 of the positive lead-out terminal 5P of the first resistor 3 extends outward in the longitudinal direction, and the extension portion 52 of the positive lead-out terminal 5P of the second resistor 3 extends outward in the longitudinal direction.

In other respects, the configuration is the same as for the first embodiment.

This embodiment enables a reduction in size of the resistor unit 1, in a direction orthogonal to both the longitudinal direction and the opening direction. For example, it is suitable when the resistor unit 1 is to be installed within an elongated space in a power converter.

Other functions and effects provided are similar to those of the first embodiment.

A resistor unit having two resistors is shown in each of the above embodiments, however it would be equally possible for the resistor unit to have a single resistor or to have three or more resistors.

The present disclosure is not limited to the above embodiments, and may be applied to various embodiments without departing from the scope of the disclosure.

The present disclosure has been described in conformity with the embodiments. However, it is comprehended that the present disclosure is not limited to the embodiments or structures. The present disclosure includes various modified examples and modifications within the range of equivalency. In addition, various combinations and forms or other combinations and forms including only one additional element, two or more additional elements, or a portion of one additional element are also included in the scope of the present disclosure or the range of ideas.

What is claimed is:

1. A resistor unit comprising:

a case that comprises an opening face;

a resistor that is housed in the case;

cement that is filled inside the case to bury the resistor;

a lead-out terminal that is connected to the resistor in the cement and is led out of the cement through the opening face of the case; and a wire-shaped connection wiring member that is connected to the lead-out terminal, wherein the lead-out terminal comprises a protrusion portion that protrudes in an opening direction that is across the opening face, and an extension portion that extends parallel to the opening face from the protrusion portion, the case has a shape that is elongated parallel to the opening face, and the connection wiring member is led out from the lead-out terminal in a longitudinal direction of the case.

2. The resistor unit according to claim 1, wherein the extension portion has a major face and a flat plate shape, and a normal direction to the major face of the extension portion is parallel to the opening direction across the opening face.

3. The resistor unit according to claim 1, wherein the resistor has a shape that is elongated in a direction parallel to the opening face, and the extension portion is arranged to extend from the protrusion portion along a longitudinal direction of the resistor.

4. The resistor unit according to claim 3, wherein the lead-out terminal comprises a plurality of lead-out terminals, and at least one of the lead-out terminals is disposed such that the extension portion thereof overlaps the resistor in the opening direction.

5. The resistor unit according to claim 1, wherein the lead-out terminal comprises a plurality of lead-out terminals, and the plurality of lead-out terminals are configured that the extension portions extend from the respective protrusion portions in a direction parallel to the opening face.

6. The resistor unit according to claim 5, wherein the plurality of lead-out terminals are configured that the extension portions extend from the respective protrusion portions in a longitudinal direction of the case, and the plurality of lead-out terminals are separately disposed in a lateral direction of the case.

7. The resistor unit according to claim 1, wherein the lead-out terminal at least comprises a first lead-out terminal, a second lead-out terminal, and a third lead-out terminal, the case has opposing first and second ends in the longitudinal direction, the protrusion portions of the respective first and second lead-out terminals are arranged adjacent to the first end of the case, and the protrusion portion of the third lead-out terminal is arranged adjacent to the second end of the case, and the extension portions of the respective first and second lead-out terminals are arranged not to face the extension portion of the third lead-out terminal in the longitudinal direction.

* * * * *